US009640126B2

(12) United States Patent
Sun et al.

(10) Patent No.: US 9,640,126 B2
(45) Date of Patent: May 2, 2017

(54) ARRAY SUBSTRATE, DRIVING METHOD THEREOF AND DISPLAY PANEL

(71) Applicants: BOE Technology Group Co., Ltd., Beijing (CN); Beijing BOE Display Technology Co., Ltd., Beijing (CN)

(72) Inventors: Zhihua Sun, Beijing (CN); Baoyu Liu, Beijing (CN); Weichao Ma, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 119 days.

(21) Appl. No.: 14/573,829

(22) Filed: Dec. 17, 2014

(65) Prior Publication Data

US 2016/0035302 A1 Feb. 4, 2016

(30) Foreign Application Priority Data

Jul. 31, 2014 (CN) ..... 2014 1 0373821

(51) Int. Cl.
*G09G 3/36* (2006.01)

(52) U.S. Cl.
CPC ..... *G09G 3/3648* (2013.01); *G09G 3/3614* (2013.01); *G09G 2330/021* (2013.01)

(58) Field of Classification Search
CPC ..... G02F 1/136286; G02F 1/134336; G02F 1/133711; G02F 1/13624; G02F 2001/134345; G09G 2300/0426; G09G 2330/021; G09G 3/3614; G09G 3/3677; G09G 2320/0233; G09G 3/3659;
(Continued)

(56) References Cited

U.S. PATENT DOCUMENTS 7,580,026 B2 * 8/2009 Liu ..... G02F 1/167 345/107
2006/0109227 A1 * 5/2006 Park ..... G09G 3/3614 345/98
2012/0287349 A1 * 11/2012 Tsubata ..... G09G 3/3637 348/731

FOREIGN PATENT DOCUMENTS

CN 1955824 A 5/2007
CN 102033368 A 4/2011
(Continued)

OTHER PUBLICATIONS

Dec. 23, 2015—(CN)—First Office Action Appn No. 201410373821.X with English Tran.
(Continued)

*Primary Examiner* — Duc Dinh
(74) *Attorney, Agent, or Firm* — Banner & Witcoff, Ltd.

(57) ABSTRACT

Embodiments of the present invention disclose an array substrate, a driving method thereof and a display panel. The array substrate includes: data lines, connected with a source driver IC; gate lines, connected with a gate driver IC; and pixel units, arranged in an array, wherein each row of pixel units are connected with a first gate line and a second gate line, the first gate line receives a gate driving signal in the case of displaying an odd frame image, the second gate line receives a gate driving signal in the case of displaying an adjacent even frame image, each pixel unit comprises a first and second TFTs, the first TFT is connected with the first gate line; the second TFT is connected with the second gate line; each column of pixel units are connected with two data lines, two adjacent columns of pixel units share one data line.

18 Claims, 7 Drawing Sheets

(58) Field of Classification Search
CPC ..... G09G 3/3674; G09G 2310/0278; G09G 2370/08; G09G 3/2074; G09G 3/3406; G09G 3/36
USPC ..... 345/204, 209, 98, 99, 100
See application file for complete search history.

(56) References Cited

FOREIGN PATENT DOCUMENTS

| | | | |
|---|---|---|---|
| CN | 103728751 | A | 4/2014 |
| KR | 20110138006 | A | 12/2011 |
| KR | 20120077562 | A | 7/2012 |

OTHER PUBLICATIONS

Jun. 1, 2016—(CN) Second Office Action (with English Translation)—App. No. 201410373821.X.

* cited by examiner

ARRAY SUBSTRATE, DRIVING METHOD THEREOF AND DISPLAY PANEL

This application claims priority to Chinese Patent Application No. 201410373821.X, filed on Jul. 31, 2014. The present application claims priority to and the benefit of the above-identified application and is incorporated herein in its entirety.

TECHNICAL FIELD

Embodiments of the present invention relate to an array substrate, a driving method thereof and a display panel.

BACKGROUND

In general, a liquid crystal display (LCD) panel comprises a plurality of pixel units defined by a plurality of gate lines and a plurality of data lines intersected with each other. Each of the plurality of pixel units comprises a thin-film transistor (TFT) and a pixel electrode, wherein each of the plurality of gate lines is connected to a gate driver integrated circuit (IC) and configured to provide a driving signal for each TFT and each of the plurality of data lines is connected to a source driver IC and configured to provide an image signal for each TFT. Moreover, the pixel electrode is connected to each TFT. Thus, an electric field is formed between the pixel electrode and a common electrode, and hence the deflection of liquid crystal can be controlled and the amount of transmitted light can be adjusted.

Herein, the gate driver IC applies the driving signal to control on/off of the TFT connected with the gate line. Moreover, when the TFT is switched on, the image signal applied by the source driver IC is applied to the TFT through the data line.

Illustratively, as illustrated in FIG. 1, each gate line connected with the gate driver IC is connected with gates of one row of TFTs, and each data line connected with the source driver IC is connected with sources of one column of TFTs. In the case of image display, one row of TFTs are switched on at the same time. As liquid crystal molecules are in the control of one kind of electrical field for a long time, the polarization phenomenon can be caused.

SUMMARY

Embodiments of the present invention provide an array substrate, a driving method thereof and a display panel, which can avoid the polarization phenomenon of liquid crystal molecules and reduce the power consumption and the manufacturing cost of the display panel.

On one hand, the embodiment of the present invention provides an array substrate, which comprises: a plurality of data lines, connected with a source driver integrated circuit (IC); a plurality of gate lines, intercrossed with the plurality of data lines and connected with a gate driver IC; and a plurality of pixel units, arranged in an array and defined by the plurality of data lines and the plurality of gate lines intercrossed with each other, wherein each row of pixel units are connected with a first gate line and a second gate line, the first gate line is configured to receive a gate driving signal outputted by the gate driver IC in the case of displaying an odd frame image, the second gate line is configured to receive a gate driving signal outputted by the gate driver IC in the case of displaying an adjacent even frame image, each pixel unit comprises a first thin-film transistor (TFT) and a second TFT, the first TFT is connected with the first gate line; the second TFT is connected with the second gate line; each column of pixel units are connected with two data lines, two adjacent columns of pixel units share one data line; as for the same frame image, the source driving signals outputted by the source driver IC and received by two adjacent data lines have opposite polarity; and as for two adjacent frame images, the source driving signals outputted by the source driver IC and received by the same data line have same polarity.

On the other hand, the embodiment of the present invention provides a driving method for the above array substrate, which comprises: in the case of displaying an odd frame image, the gate driver IC drives the first gate lines sequentially one by one, the first TFT connected with the first gate line is switched on, a source driving signal is outputted to the data line connected with the source of the first TFT by the source driver IC and transmitted to the pixel electrode connected with the drain through the drain electrode of the first TFT; in the case of displaying an even frame image, the gate driver IC drives the second gate lines sequentially one by one, the second TFT connected with the second gate line is switched on, a source driving signal is outputted to the data line connected with the source of the second TFT by the source driver IC and transmitted to the pixel electrode connected with the drain through the drain of the second TFT.

In still another aspect, the embodiment of the present invention further provides a display panel, which comprises: the above array substrate; and an opposing substrate, arranged opposite to the array substrate.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Embodiments of the present invention provide an array substrate, a driving method thereof and a display panel, which can avoid the polarization phenomenon of liquid crystal molecules and reduce the power consumption and the manufacturing cost of the display panel.

Figure 1:
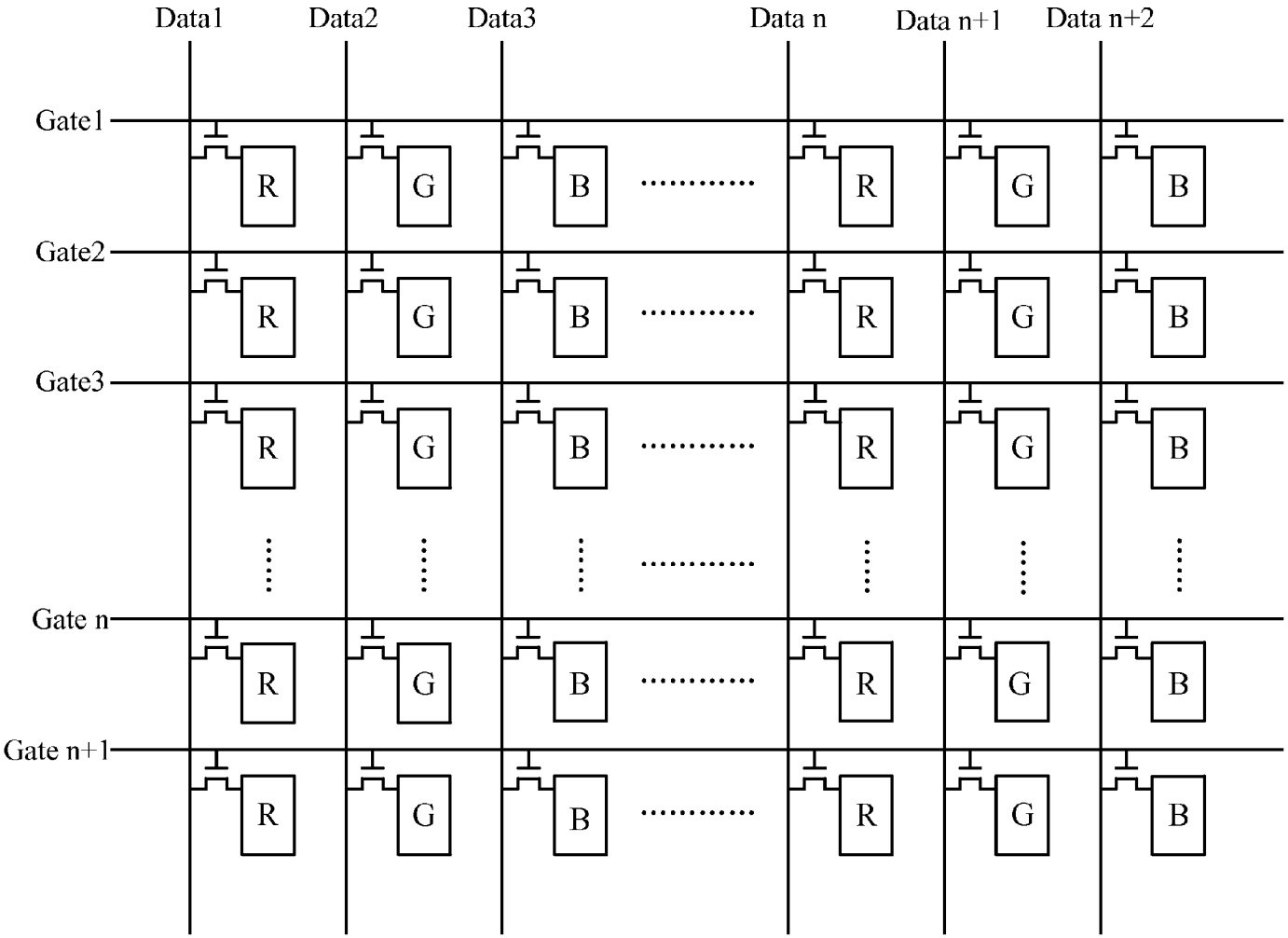
FIG. 1 is a schematic structural view of a current array substrate.
Figure 2:
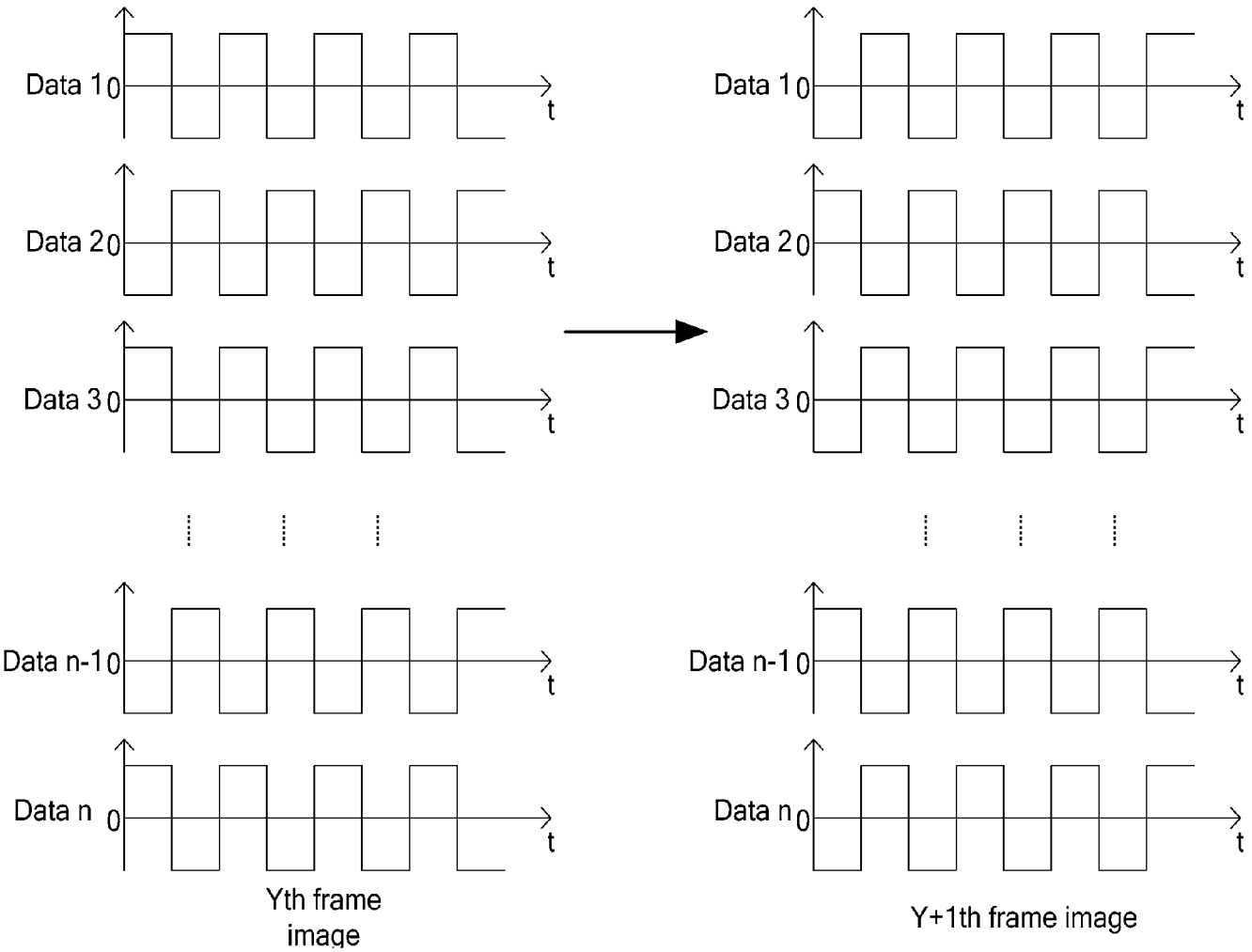
FIGS. 2(*a*) and 2(*b*) are respectively a timing view of signals applied to data lines of an array substrate and an effect view of dot-inversion.
Figure 2:
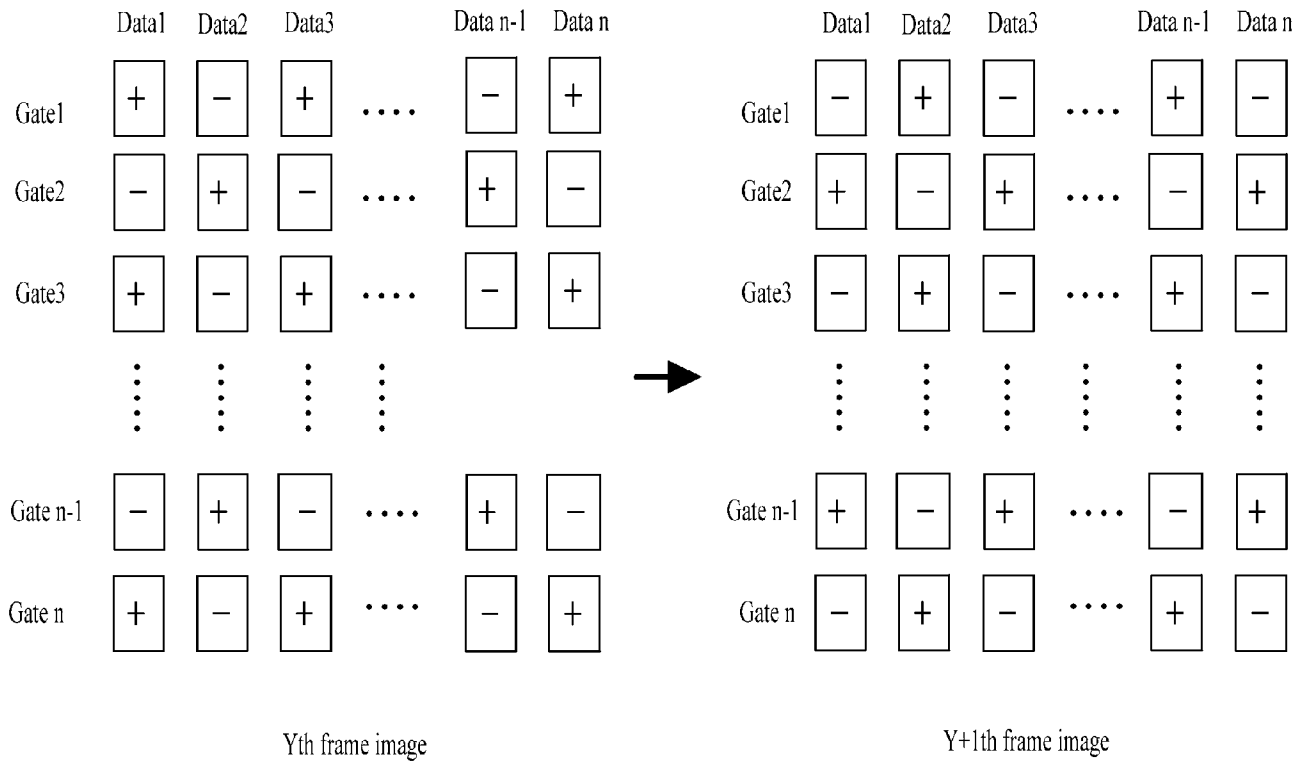

In order to avoid the polarization phenomenon caused by a fact that liquid crystal molecules are in the control of one electrical field for a long time, a polarity inversion is adopted between frames and a polarity inversion unit is disposed in a source driver IC and controlled by a polarity signal, so that a voltage applied to each pixel by a data line is alternately transformed between a positive voltage and a negative voltage, and hence the display effect of dot-inversion in the display panel can be achieved. The effect view of the dot-inversion is as shown in FIG. 2(*b*). The core concept of the dot-inversion is that: in the case of displaying the Yth frame image, datas on every two adjacent data lines have opposite polarity; in the case of displaying the Y+1th frame image, a signal on the same data line has opposite polarity with those in the case of displaying the Yth frame image, and datas on every two adjacent data lines have opposite polarity. FIG. 2(*a*) is a schematic view illustrating the polarity of a source driving signal received by each data line, in which the polarity of the source driving signal received by each data line alternately switches between positive and negative, and the polarities of the signals on the same data line at the same moment in two adjacent frame images are opposite, and hence not only the polarization phenomenon of liquid crystal can be prevented but also the power consumption can be reduced, in which Y is an integer more than or equal to 1.

But as for the above dot-inversion, in the case of displaying the same frame image, the polarity of an image signal applied to each data line must be inverted once along with the sequential application of scanning signals to the gate lines, and hence a lot of energy is consumed and the temperature of the source driver IC of the display panel tends to be raised. For instance, in order to achieve the dot-inversion effect, supposing that the polarity of a data signal in a pixel of a first row and a first column is positive, the polarity of a data signal in a pixel of the second row and the first column must be negative, thus, when the gate driver IC drives the gate line for the second row after the gate line for the first row is drove, the polarity of the signal in the first data line will be converted from positive to negative. In this case, as for the above dot-inversion, the source driver IC must switch the polarity of the signal within large voltage range when outputting the signal with opposite polarity. Due to the continuous polarity switching of the source driver IC, the power consumption may be greatly increased and the temperature of the source driver IC may be also raised. Moreover, as the polarity inversion unit needs to be manufactured in the source driver IC, the manufacturing cost is higher.

Detailed description will be given below to another array substrate and a driving method thereof, provided by an embodiment of the present invention, capable of reducing the power consumption of a display panel and reducing the manufacturing cost, with reference to the accompanying drawings.

Figure 3:
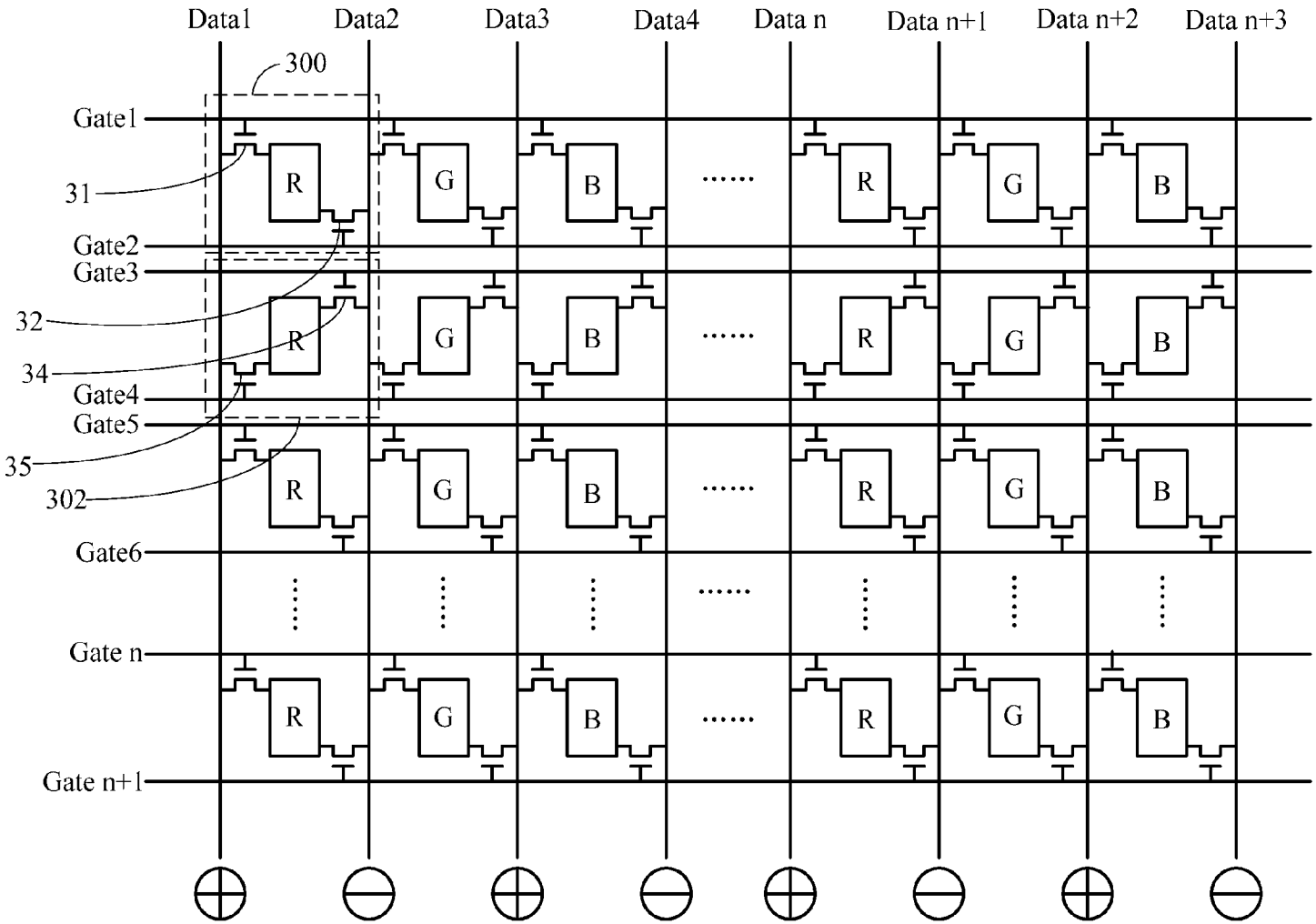
FIG. 3 is a schematic structural view of an array substrate provided by an embodiment of the present invention.

As illustrated in FIG. 3, an embodiment of the present invention provides an array substrate, which comprises: a plurality of data lines Data 1, Data 2, Data 3, etc., connected with a source driver IC; a plurality of gate lines Gate 1, Gate 2, Gate 3, etc., intercrossed with the plurality of data lines and connected with a gate driver IC; and a plurality of pixel units 300, arranged in an array and defined by the plurality of data lines and the plurality of gate lines intercrossed with each other, wherein each row of pixel units are correspondingly connected with a first gate line and a second gate line. For instance, a first row of pixel units are connected with a first gate line Gate 1 and a second gate line Gate 2. Illustratively, the first gate line is disposed at one side of each row of pixel units; the second gate line is disposed at the other side of the row of pixel units; the first gate line is configured to receive a gate driving signal outputted by the gate driver IC in the case of displaying an odd frame image; and the second gate line is configured to receive a gate driving signal outputted by the gate driver IC in the case of displaying an adjacent even frame image, that is to say, in the case of displaying two adjacent frame images, each row of pixel units can display normally; each pixel unit comprises two TFTs, for instance, the pixel unit 300 comprises a first thin film transistor TFT 31 and a second thin film transistor TFT 32; the first TFT is connected with the first gate line; and the second TFT is connected with the second gate line. For instance, the pixel unit 300 is connected with the first gate line Gate 1 through the TFT 31 and connected with the second gate line Gate 2 through the TFT 32. Each column of pixel units are connected with two data lines, and two adjacent columns of pixel units share one data line. For instance, the first column of pixel units are connected with the data lines Data 1 and Data 2, and the first column of pixel units and the second column of pixel units share the data line Data 2. As for the same frame image, source driving signals outputted by the source driver IC and received by two adjacent data lines have opposite polarity; and as for two adjacent frame images, source driving signals outputted by the source driver IC and received by the same data line have same polarity. For instance, as for the same frame image, the polarity of the source driving signal outputted by the source driver IC and received by the data line Data 1 is positive and the polarity of the source driving signal outputted by the source driver IC and received by the data line Data 2 is negative; and as for two adjacent frame images, the polarities of the source driving signals outputted by the source driver IC and received by the data line Data 1 are all positive and the polarities of the source driving signals outputted by the source driver IC and received by the data line Data 2 are all negative. Illustratively, in the embodiment of the present invention, the polarity of the source driving signal outputted by the source driver IC and received by the data line Data 1 may also be negative and the polarity of the source driving signal outputted by the source driver IC and received by the data line Data 2 may also be positive. No specific limitation will be given in the embodiment of the present invention.

In the embodiment of the present invention, the first gate line and the second gate line may be extended along a horizontal direction and may also be extended along a vertical direction. Correspondingly, the data lines may be extended along the vertical direction and may also be extended along the horizontal direction. Thus, two adjacent rows of pixel units may be adjacent to each other in the vertical direction and may also be adjacent to each other in the horizontal direction. Correspondingly, two adjacent columns of pixel units may be adjacent to each other in the horizontal direction and may also be adjacent to each other in the vertical direction. No limitation will be given in the embodiment of the present invention. Description is given here by taking the case that a row direction is the horizontal direction and a column direction is the vertical direction as an example.

Illustratively, as illustrated in FIG. 3, in the embodiment of the present invention, the two TFTs of each pixel unit are respectively disposed at diagonal positions of the pixel unit, namely disposed at two corners along a diagonal direction of the pixel unit. For instance, the TFT 31 and the TFT 32 in the pixel unit 300 are respectively disposed at diagonal positions of the pixel unit 300. Two gate lines are extended between two adjacent rows of pixel units, for instance, two gate lines Gate 2 and Gate 3 are extended between the first row of pixel units and the second row of pixel units adjacent to each other.

Illustratively, two data lines connected with each column of pixel units are respectively disposed on two opposite sides of the column of pixel unit; the first TFT is connected to one of the two data lines closer to the first TFT, and the second TFT is connected with the other data line. Moreover, it should be noted by those skilled in the art that the two TFTs of each pixel unit may also be arranged in other manners as long as one of the two TFTs is connected to one of the two data lines closer to the TFT. For instance, the two TFTs may be disposed at positions slightly deviated from the diagonal direction of the pixel unit and respectively disposed at a left side and a right side of a diagonal line, or one of the two TFTs may be disposed at a left half part of the pixel unit and the other may be disposed at a right half part of the pixel unit, as long as a distance between each of the two TFTs and one of the two data lines and a distance between the TFT and the other of the two data lines are unequal. The embodiment of the present invention is not intended to limit this and is not limited to the arrangement illustrated in the accompanying drawings.

Illustratively, four gate lines connected with two adjacent rows of pixel units are combined into one gate line unit, for example, four gate lines Gate 1, Gate 2, Gate 3 and Gate 4 connected with the first row of pixel units and the second row of pixel units are combined into one gate line unit. The array substrate provided by the embodiment of the present invention comprises a plurality of gate line units arranged along a column direction, each gate line unit comprises four gate lines and the four gate lines are a first gate line, a second gate line, a first gate line and a second gate line in sequence, that is to say, Gate 1 is the first gate line, Gate 2 is the second gate line, Gate 3 is the first gate line, Gate 4 is the second gate line; Or, the four gate lines are a first gate line, a second gate line, a second gate line and a first gate line in sequence, that is to say, Gate 1 is the first gate line, Gate 2 is the second gate line, Gate 3 is the second gate line and Gate 4 is the first gate line.

In the embodiment of the present invention, in the case that the four gate lines in one gate line unit are the first gate line, the second gate line, the first gate line and the second gate line in sequence, as illustrated in FIG. 3, a gate of a first TFT of a pixel unit in an odd row is connected with the first gate line above the pixel unit, a source is connected with the data line at a left side of the pixel unit, and a drain is connected with a pixel electrode in the pixel unit; a gate of a second TFT of the pixel unit is connected with the second gate line below the pixel unit, a source is connected with the data line at a right side of the pixel unit and a drain is connected with the pixel electrode in the pixel unit; a gate of a first TFT of a pixel unit in an even row is connected with the first gate line above the pixel unit, a source is connected with the data line at a right side of the pixel unit and a drain is connected with a pixel electrode in the pixel unit; and a gate of a second TFT of the pixel unit is connected with the second gate line below the pixel unit, a source is connected with the data line at a left side of the pixel unit and a drain is connected with the pixel electrode in the pixel unit.

As illustrated in FIG. 3, in the embodiment of the present invention, as for an odd frame image, e.g., the Yth frame image, the first gate line receives a gate driving signal outputted by the gate driver IC; and as for an adjacent even frame image, e.g., the Y+1th frame image, the second gate line receives a gate driving signal outputted by the gate driver IC.

Illustratively, as for an odd frame image, e.g., the Yth frame image, the gate driver IC sequentially drives the gate lines Gate 1, Gate 3, Gate 5, etc. one by one; and as for an adjacent even frame image, e.g., the Y+1th frame image, the gate driver IC sequentially drives the gate lines Gate 2, Gate 4, Gate 6, etc. one by one. The TFTs connected with two gate lines between two adjacent rows of pixel units are disposed on the same side of one column of pixel units, for instance, a TFT 32 in a pixel unit 300 and a TFT 34 in an adjacent pixel unit 302 are disposed at the right side of the first column of pixel units 300 and 302.

Figure 4:
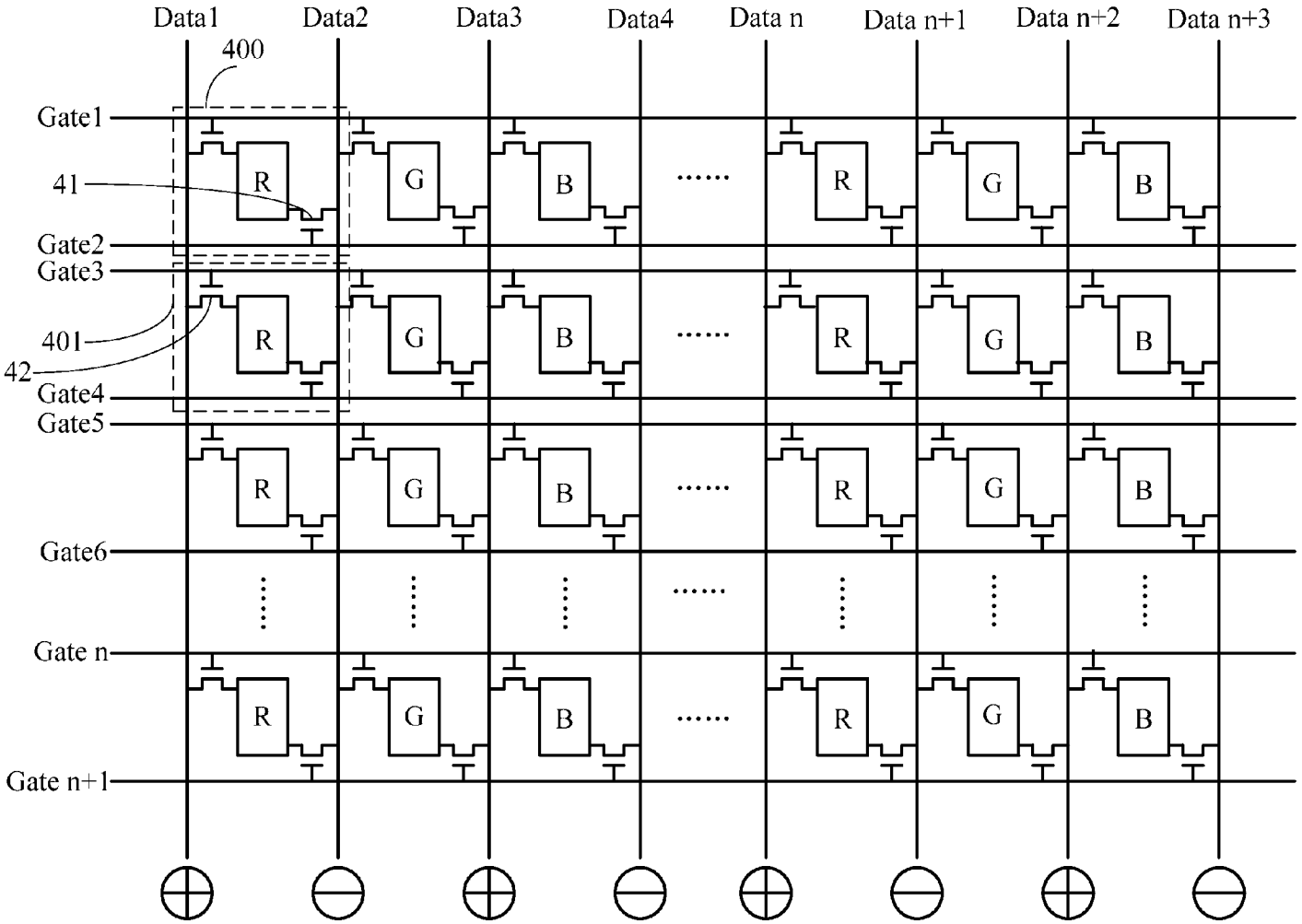
FIG. 4 is a schematic structural view of another array substrate provided by an embodiment of the present invention.

In the embodiment of the present invention, in the case that the four gate lines in the gate line unit are the first gate line, the second gate line, the second gate line and the first gate line in sequence, as illustrated in FIG. 4, a gate of a first TFT of a pixel unit in an odd row is connected with the first gate line above the pixel unit, a source is connected with the data line at a left side of the pixel unit, a drain is connected with a pixel electrode in the pixel unit; a gate of a second TFT of the pixel unit is connected with the second gate line below the pixel unit, a source is connected with the data line at a right side of the pixel unit, a drain is connected with the pixel electrode in the pixel unit; a gate of a first TFT of a pixel unit in an even row is connected with the first gate line below the pixel unit, a source is connected with the data line at a right side of the pixel unit, a drain is connected with a pixel electrode in the pixel unit; and a gate of a second TFT of the pixel unit is connected with the second gate line above the pixel unit, a source is connected with the data line on the left side of the pixel unit and a drain is connected with the pixel electrode in the pixel unit.

As illustrated in FIG. 4, in the embodiment of the present invention, as for an odd frame image, e.g., the Yth frame image, the first gate line receives a gate driving signal outputted by the gate driver IC; and as for an adjacent even frame image, e.g., the Y+1th frame image, the second gate line receives a gate driving signal outputted by the gate driver IC.

Illustratively, as for an odd frame image, e.g., the Yth frame image, the gate driver IC drives the gate lines Gate 1, Gate 4, Gate 5, etc. one by one sequentially; and as for an adjacent even frame image, e.g., the Y+1th frame image, the gate driver IC drives the gate lines Gate 2, Gate 3, Gate 6, etc. one by one sequentially. The TFTs connected with two gate lines between two adjacent rows of pixel units are disposed on both sides of one column of pixel units. For instance, a TFT 41 in a pixel unit 400 and a TFT 42 in an adjacent pixel unit 401 are disposed on both sides of the first column of pixel units 400 and 401.

As illustrated in FIG. 3 or 4, in the embodiment of the present invention, as for an odd frame image, e.g., the Yth frame image, source driving signals outputted by the source driver IC and received by the data lines Data 1, Data 3, Data 5, etc. in the odd column have same polarity, e.g., the polarity of the received source driving signals outputted by the source driver IC is positive and, of course, may also be negative; and source driving signals outputted by the source driver IC and received by the data lines Data 2, Data 4, Data 6, etc. in the even column have same polarity, e.g., the polarity of the received source driving signals outputted by the source driver IC is negative and, of course, may also be positive. The polarity of the source driving signals outputted by the source driver IC and received by the data lines in the odd column such as Data 1, Data 3 and Data 5 and the polarity of the source driving signals received by the data lines in the even column such as Data 2, Data 4 and Data 6 are opposite.

Illustratively, in the embodiment of the present invention, the four gate lines in each gate line unit may be a second gate line, a first gate line, a second gate line and a first gate line in sequence or may be a second gate line, a first gate line, a first gate line and a second gate line in sequence.

Illustratively, in the case that the four gate lines are the second gate line, the first gate line, the second gate line and the first gate line in sequence, a gate of a first TFT of a pixel unit in an odd row is connected with the first gate line below the pixel unit, a source is connected with the data line at a right side of the pixel unit, a drain is connected with a pixel electrode in the pixel unit; a gate of a second TFT of the pixel unit is connected with the second gate line above the pixel unit, a source is connected with the data line at a left side of the pixel unit and a drain is connected with the pixel electrode in the pixel unit; a gate of a first TFT of a pixel unit in an even row is connected with the first gate line below the pixel unit, a source is connected with the data line at the left side of the pixel unit, a drain is connected with a pixel electrode in the pixel unit; and a gate of a second TFT of the pixel unit is connected with the second gate line above the pixel unit, a source is connected with the data line on the right side of the pixel unit and a drain is connected with the pixel electrode in the pixel unit.

Illustratively, in the case that the four gate lines are the second gate line, the first gate line, the first gate line and the second gate line in sequence, a gate of a first TFT of a pixel unit in an odd row is connected with the first gate line below the pixel unit, a source is connected with the data line on the right side of the pixel unit, a drain is connected with a pixel electrode in the pixel unit; a gate of a second TFT of the pixel unit is connected with the second gate line above the pixel unit, a source is connected with the data line on the left side of the pixel unit, a drain is connected with the pixel electrode in the pixel unit; a gate of a first TFT of a pixel unit in an even row is connected with the first gate line above the pixel unit, a source is connected with the data line on the left side of the pixel unit, a drain is connected with a pixel electrode in the pixel unit; and a gate of a second TFT of the pixel unit is connected with the second gate line below the pixel unit, a source is connected with the data line on the right side of the pixel unit, a drain is connected with the pixel electrode in the pixel unit.

In the array substrate provided by the embodiment of the present invention, each row of pixel units in the array substrate are correspondingly connected with a first gate line and a second gate line; the first gate line is configured to receive a gate driving signal outputted by the gate driver IC in the case of displaying an odd frame image; the second gate line is configured to receive a gate driving signal outputted by the gate driver IC in the case of displaying an adjacent even frame image; each pixel unit comprises two TFTs; a first TFT is connected with the first gate line; a second TFT is connected with the second gate line; that is to say, as for the same frame image, only one TFT of the two TFTs correspondingly connected with each pixel unit receives the gate driving signal outputted by the gate driver IC and is switched on and the other TFT is switched off; each column of pixel units are correspondingly connected with two data lines, and two adjacent columns of pixel units share one data line; as for the same frame image, source driving signals outputted by the source driver IC and received by two adjacent data lines have opposite polarity; and as for two adjacent frame images, source driving signals outputted by the source driver IC and received by the same data line have same polarity. Meanwhile, as the gate driving signals outputted by the gate driver IC are received by the first gate line and the second gate line respectively in the case of displaying two adjacent frame images, the dot-inversion can still be achieved as for the two adjacent frame images. Moreover, in the case of dot-inversion, the polarity of the source driving signals outputted by the source driver IC and received by the same data line is unchanged and the source driver IC does not need to switch the polarity of the source driving signals of the source driver IC between frame images, and hence the power consumption of the display panel can be reduced. Meanwhile, as a polarity inversion unit is not required to be manufactured in the source driver IC, the manufacturing cost can be reduced.

On the other hand, an embodiment of the present invention further provides a method for driving the above array substrate. The method comprises:

S501: in the case of displaying an odd frame image, the gate driver IC drives the first gate lines one by one sequentially, the first TFT connected with the first gate line is switched on and a source driving signal is outputted to the data line connected with the first TFT by the source driver IC and transmitted to the pixel electrode connected with the drain through the drain of the first TFT.

S502: in the case of displaying an even frame image, the gate driver IC drives the second gate lines one by one sequentially; the second TFT connected with the second gate line is switched on; and a source driving signal is outputted to the data line connected with the second TFT by the source driver IC and transmitted to the pixel electrode connected with the drain through the drain of the second TFT.

As for the same frame image, source driving signals received by two adjacent data lines have opposite polarity; and as for two adjacent frame images, source driving signals received by the same data line have same polarity. In the case of switching on corresponding the TFT, the dot-inversion of pixels can be conveniently achieved by the coordination of the source driving signals outputted by the source driver IC.

Figure 5:
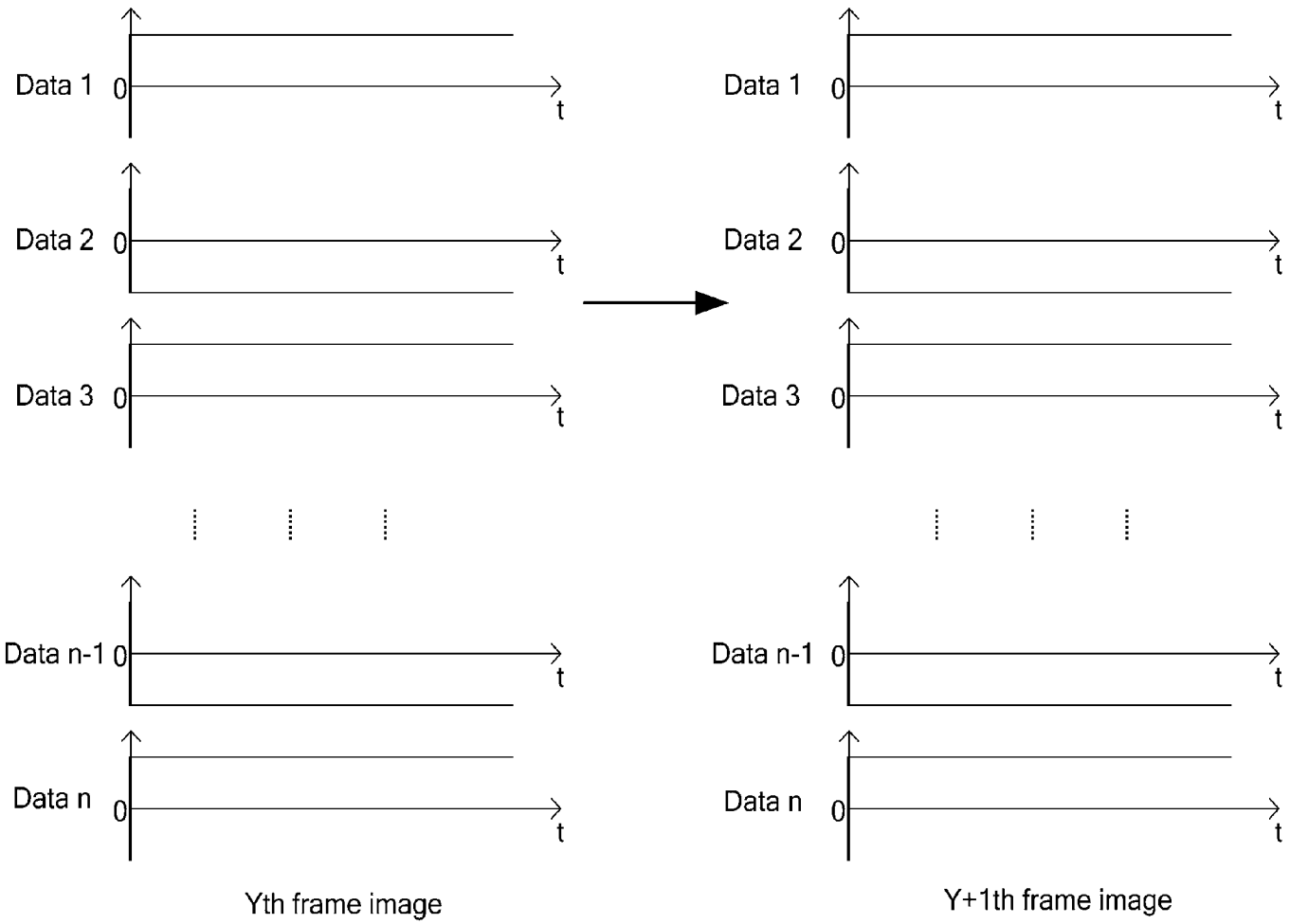
FIGS. 5(*a*) and 5(*b*) are respectively a timing view of signals applied to data lines of the array substrate provided by an embodiment of the present invention and an effect diagram of dot-inversion.
Figure 5:
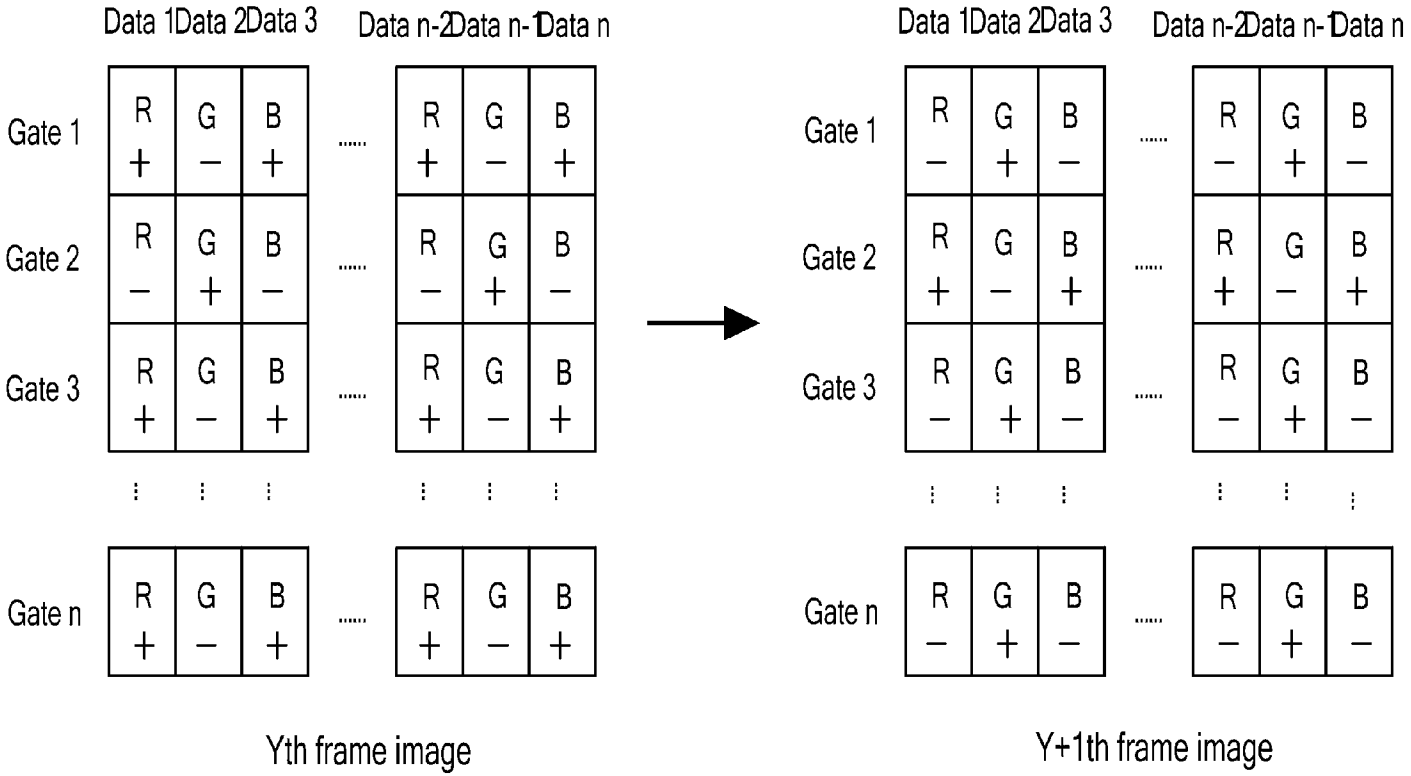

Illustratively, as illustrated in FIG. 3, in the embodiment of the present invention, the gate lines in the odd rows and the gate lines in the even rows are switched on alternately in the case of displaying two adjacent frame images, e.g., displaying the Yth frame image and the Y+1th frame image. In the case of displaying the Yth frame image, the gate lines Gate 1, Gate 3, Gate 5, etc. in the odd rows are switched on in sequence; pixels in the same column of pixel units are charged by data lines alternately on the left side and the right side of the column of pixel units. As for the same frame image, e.g., the Yth frame image, the source driving signals outputted by the source driver IC to adjacent data lines have opposite polarity, and the source driving signals outputted to alternate data lines (any two data lines between which there is one data line) have same polarity. At this point, the polarity of the source driving signals received by the pixels R in the first row of pixel units through data lines connected with TFTs is positive; the polarity of the source driving signals received by the pixels G through data lines connected with TFTs is negative; the polarity of the source driving signals received by the pixels B through data lines connected with TFTs is positive. The polarity of the source driving signals received by pixels R in the second row of pixel units through data lines connected with TFTs is negative; the polarity of the source driving signals received by pixels G through data lines connected with TFTs is positive; and the polarity of the source driving signals received by pixels B through data lines connected with TFTs is negative, as illustrated in FIG. 5(*b*). In the case of displaying the Y+1th frame image, the gate lines Gate 2, Gate 4, Gate 6, etc. in the even rows are switched on in sequence. As for two adjacent frame images, the source driving signals outputted by the source driver IC to the same data line have same polarity. At this point, pixels in the same column of pixel units are charged by the data lines alternately at the right side and the left side of the column of pixel units. Thus, the polarity of the source driving signals received by the pixels R in the first row of pixel units through data lines connected with TFTs is negative; the polarity of the source driving signals received by the pixels G through data lines connected with TFTs is positive; and the polarity of the source driving signals received by the pixels B through data lines connected with TFTs is negative. The polarity of the source driving signals received by the pixels R in the second row of pixel units through data lines connected with TFTs is positive; the polarity of the source driving signals received by pixels G through data lines connected with TFTs is negative; and the polarity of the source driving signals received by pixels B through data lines connected with TFTs is positive. As for the same frame image, e.g., the Yth frame image or the Y+1th frame image, the polarity of the source driving signals received by adjacent pixels through data lines connected with TFTs is opposite. As for two adjacent frame images, e.g., the Yth frame image and the Y+1th frame image, the polarity of the source driving signals received by pixels at the same position is opposite. Thus, the source driver IC does not need to switch the polarity between frames and always maintains the same polarity. That is to say, the polarity of the source driving signals received by each data line in FIG. 5(*a*) is not required to be switched between frames, and hence the dot-inversion effect in the display of the display panel can be achieved and the polarization phenomenon of liquid crystal molecules can be avoided.

Illustratively, as illustrated in FIG. 4, in the embodiment of the present invention, as for two adjacent frame images, e.g., the Yth frame image and the Y+1th frame image, in the case of displaying the Yth frame image, the gate lines Gate 1, Gate 4, Gate 5, etc. are switched on in sequence, and pixels in the same column of pixel units are respectively charged by data lines alternately at the left side and the right side of the column of pixel units. As for the same frame image, e.g., the Yth frame image, the polarity of the source driving signals outputted by the source driver IC to adjacent data lines is opposite, and the polarity of the source driving signals outputted to alternate data lines is same. At this point, the polarity of the source driving signals received by pixels R in the first row of pixel units through data lines connected with TFTs is positive; the polarity of the source driving signals received by pixels G through data lines connected with TFTs is negative; and the polarity of the source driving signals received by pixels B through data lines connected with TFTs is positive. The polarity of the source driving signals received by pixels R in the second row of pixel units through data lines connected with TFTs is negative; the polarity of the source driving signals received by pixels G through data lines connected with TFTs is positive; and the polarity of the source driving signals received by pixels B through data lines connected with TFTs is negative, as illustrated in FIG. 5(*b*). In the case of displaying the Y+1th frame image, the gate lines Gate 2, Gate 3, Gate 6, etc. are switched on in sequence. As for two adjacent frame images, the polarity of the source driving signals outputted by the source driver IC to the same data line is same. At this point, pixels in the same column of pixel units are respectively charged by data lines alternately on the right side and the left side of the column of pixel units. Thus, the polarity of the source driving signals received by pixels R in the first row of pixel units through data lines connected with TFTs is negative; the polarity of the source driving signals received by pixels G through data lines connected with TFTs is positive; and the polarity of the source driving signals received by pixels B through data lines connected with TFTs is negative. The polarity of the source driving signals received by pixels R in the second row of pixel units through data lines connected with TFTs is positive; the polarity of the source driving signals received by pixels G through data lines connected with TFTs is negative; and the polarity of the source driving signals received by pixels B through data lines connected with TFTs is positive. As for the same frame, e.g., the Yth frame image or the Y+1th frame image, the polarity of the source driving signals received by adjacent pixels through data lines connected with TFTs is opposite. As for two adjacent frame images, e.g., the Yth frame image and the Y+1th frame image, the polarity of the source driving signals received by pixels at the same position is opposite. Thus, the source driver IC does not need to switch the polarity between frames and always maintains the same polarity. That is to say, the polarity of the source driving signals received by each data line in FIG. 5(*a*) is not required to be switched between frames, and hence the dot-inversion effect in the display of the display panel can be achieved and the polarization phenomenon of liquid crystal molecules can be avoided.

According to the method for driving the array substrate provided by the embodiment of the present invention, the method comprises: in the case of displaying an odd frame image, the gate driver IC drives the first gate lines one by one according to the scanning order, and when the TFT is switched on, the source driver IC outputs a source driving signal to a data line; and in the case of displaying an even frame image, the gate driver IC drives the second gate lines one by one according to the scanning order, and when the TFT is switched on, the source driver IC drives a data line to output a source driving signal. The method is simple and convenient in the actual driving process and can ensure that each row of pixels can display a complete image in both the odd frame and the even frame.

Moreover, the embodiment of the present invention further relates to a timing controller which does not provide a polarity inversion signal. When the timing controller processes data, there is a difference of one column of data signal lines between odd frame image data and even frame image data, namely the dislocation of data lines is caused.

The embodiment of the present invention further provides a display panel, which comprises: any foregoing array substrate and an opposing substrate arranged opposite to the array substrate.

In summary, in the embodiment of the present invention, the source driver IC does not need polarity inversion, so that the power consumption can be reduced by about 30%, and hence the embodiment of the present invention is particularly applicable to the current large-dimension and high-resolution LCD products. Meanwhile, as the polarity inversion unit is not required in the source driver IC, the cost can be reduced.

Obviously, various modifications and deformations can be made to the present invention by those skilled in the art without departing from the spirit and scope of the present invention. Therefore, if the modifications and deformations of the present invention fall within the scope of the appended claims of the present invention and equivalents thereof, the present invention is also intended to comprise the modifications and deformations.

The invention claimed is:

1. An array substrate, comprising:

a plurality of data lines, connected with a source driver integrated circuit (IC);

a plurality of gate lines, intercrossed with the plurality of data lines and connected with a gate driver IC; and a plurality of pixel units, arranged in an array and defined by the plurality of data lines and the plurality of gate lines intercrossed with each other, wherein each row of pixel units are connected with a first gate line and a second gate line, the first gate line is configured to receive a gate driving signal outputted by the gate driver IC in a case of displaying an odd frame image, the second gate line is configured to receive a gate driving signal outputted by the gate driver IC in a case of displaying an adjacent even frame image, each pixel unit comprises a first thin-film transistor (TFT) and a second TFT, the first TFT is connected with the first gate line, and the second TFT is connected with the second gate line, wherein each column of pixel units is connected with two data lines, two adjacent columns of pixel units share one data line; as for the same frame image, the source driving signals outputted by the source driver IC and received by two adjacent data lines have opposite polarity; and as for two adjacent frame images, the source driving signals outputted by the source driver IC and received by the same data line have the same polarity, wherein the first gate line is disposed at one side of each row of pixel units, and the second gate line is disposed at the other side of each row of pixel units, wherein four gate lines connected with two adjacent rows of pixel units are combined into a gate line unit, and wherein in a case that the four gate lines are a first gate line, a second gate line, a first gate line, and a second gate line in sequence, a gate of a first TFT of a pixel unit in an odd row is connected with the first gate line above the pixel unit, a source is connected with the data line at a left side of the pixel unit, a drain is connected with a pixel electrode in the pixel unit and a gate of a second TFT of the pixel unit is connected with the second gate line below the pixel unit, a source is connected with the data line at a right side of the pixel unit, and a drain is connected with the pixel electrode in the pixel unit, and a gate of a first TFT of a pixel unit in an even row is connected with the first gate line above the pixel unit, a source is connected with the data line at a right side of the pixel unit, a drain is connected with a pixel electrode in the pixel unit; and a gate of a second TFT of the pixel unit is connected with the second gate line below the pixel unit, a source is connected with the data line at a left side of the pixel unit, and a drain is connected with the pixel electrode in the pixel unit.

2. The array substrate according to claim 1, wherein the first TFT and the second TFT of each pixel unit are respectively disposed at diagonal positions of the pixel unit.

3. The array substrate according to claim 2, wherein the two data lines connected with each column of pixel units are respectively disposed at two opposite sides of the column of pixel units; the first TFT is connected to one of the two data lines closer to the first TFT than the other of the two data lines; and the second TFT is connected with the other of the two data lines.

4. The array substrate according to claim 1, wherein in the case that the four gate lines are the first gate line, the second gate line, the first gate line and the second gate line in sequence, the TFTs connected with two gate lines between two adjacent rows of pixel units are disposed on the same side of one column of pixel units.

5. The array substrate according to claim 1, wherein in the case that the four gate lines are the first gate line, the second gate line, the second gate line and the first gate line in sequence, the TFTs connected with two gate lines between two adjacent rows of pixel units are disposed on opposite sides of one column of pixel units.

6. A driving method for the array substrate according to claim 1, comprising:

in the case of displaying an odd frame image, the gate driver IC drives the first gate lines sequentially one by one, the first TFT connected with the first gate line is switched on, and a source driving signal is outputted to the data line connected with the source of the first TFT by the source driver IC and transmitted to the pixel electrode connected with the drain through a drain electrode of the first TFT; and in the case of displaying an even frame image, the gate driver IC drives the second gate lines sequentially one by one, the second TFT connected with the second gate line is switched on, and a source driving signal is outputted to the data line connected with the source of the second TFT by the source driver IC and transmitted to the pixel electrode connected with the drain through the drain of the second TFT.

7. The driving method according to claim 6, wherein as for the same frame image, the source driving signals received by two adjacent data lines have opposite polarity; and as for two adjacent frame images, the source driving signals received by the same data line have the same polarity.

8. The driving method according to claim 6, wherein the first TFT and the second TFT of each pixel unit are respectively disposed at diagonal positions of the pixel unit.

9. The driving method according to claim 6, wherein the two data lines connected with each column of pixel units are respectively disposed on two opposite sides of the column of pixel units, the first TFT is connected to one of the two data lines closer to the first TFT than the other of the two data lines, and the second TFT is connected with the other of the two data lines.

10. The driving method according to claim 6, wherein the first gate line is disposed on one side of each row of pixel units, and the second gate line is disposed on an opposite side of each row of pixel units.

11. A display panel, comprising:

the array substrate according to claim 1; and an opposing substrate, arranged opposite to the array substrate.

12. An array substrate, comprising:

a plurality of data lines, connected with a source driver integrated circuit (IC);

a plurality of gate lines, intercrossed with the plurality of data lines and connected with a gate driver IC; and a plurality of pixel units, arranged in an array and defined by the plurality of data lines and the plurality of gate lines intercrossed with each other, wherein each row of pixel units are connected with a first gate line and a second gate line, the first gate line is configured to receive a gate driving signal outputted by the gate driver IC in a case of displaying an odd frame image, the second gate line is configured to receive a gate driving signal outputted by the gate driver IC in a case of displaying an adjacent even frame image, each pixel unit comprises a first thin-film transistor (TFT) and a second TFT, the first TFT is connected with the first gate line, and the second TFT is connected with the second gate line, wherein each column of pixel units is connected with two data lines, two adjacent columns of pixel units share one data line; as for the same frame image, the source driving signals outputted by the source driver IC and received by two adjacent data lines have opposite polarity; and as for two adjacent frame images, and the source driving signals outputted by the source driver IC and received by the same data line have the same polarity, wherein the first gate line is disposed at one side of each row of pixel units, and the second gate line is disposed at the other side of each row of pixel units, wherein four gate lines connected with two adjacent rows of pixel units are combined into a gate line unit, wherein in the case that the four gate lines are a second gate line, a first gate line, a second gate line, and a first gate line in sequence, a gate of a first TFT of a pixel unit in an odd row is connected with the first gate line below the pixel unit, a source is connected with the data line at a right side of the pixel unit, a drain is connected with a pixel electrode in the pixel unit; and a gate of a second TFT of the pixel unit is connected with the second gate line above the pixel unit, a source is connected with the data line at a left side of the pixel unit, and a drain is connected with the pixel electrode in the pixel unit, and a gate of a first TFT of a pixel unit in an even row is connected with the first gate line below the pixel unit, a source is connected with the data line at a left side of the pixel unit, a drain is connected with a pixel electrode in the pixel unit; and a gate of a second TFT of the pixel unit is connected with the second gate line above the pixel unit, a source is connected with the data line at a right side of the pixel unit, and a drain is connected with the pixel electrode in the pixel unit.

13. The array substrate according to claim 12, wherein the first TFT and the second TFT of each pixel unit are respectively disposed at diagonal positions of the pixel unit.

14. The array substrate according to claim 13, wherein the two data lines connected with each column of pixel units are respectively disposed at two opposite sides of the column of pixel units; the first TFT is connected to one of the two data lines closer to the first TFT than the other of the two data lines; and the second TFT is connected with the other of the two data lines.

15. A driving method for the array substrate according to claim 12, comprising:

in the case of displaying an odd frame image, the gate driver IC drives the first gate lines sequentially one by one, the first TFT connected with the first gate line is switched on, and a source driving signal is outputted to the data line connected with the source of the first TFT by the source driver IC and transmitted to the pixel electrode connected with the drain through a drain electrode of the first TFT; and in the case of displaying an even frame image, the gate driver IC drives the second gate lines sequentially one by one, the second TFT connected with the second gate line is switched on, and a source driving signal is outputted to the data line connected with the source of the second TFT by the source driver IC and transmitted to the pixel electrode connected with the drain through the drain of the second TFT.

16. The driving method according to claim 15, wherein as for the same frame image, the source driving signals received by two adjacent data lines have opposite polarity; and as for two adjacent frame images, the source driving signals received by the same data line have the same polarity.

17. The driving method according to claim 15, wherein the first TFT and the second TFT of each pixel unit are respectively disposed at diagonal positions of the pixel unit.

18. A display panel, comprising:

the array substrate according to claim 12; and an opposing substrate, arranged opposite to the array substrate.

* * * * *